US010642307B2

(12) United States Patent
Stoffers et al.

(10) Patent No.: US 10,642,307 B2
(45) Date of Patent: May 5, 2020

(54) APPARATUS FOR REMOVING A JOYSTICK GRIP

(71) Applicant: Sensata Technologies, Inc., Attleboro, MA (US)

(72) Inventors: Michael Stoffers, Berlin (DE); Uwe Gillmann, Berlin (DE); Henning Koschke, Berlin (DE); Joachim Meyer-Quade, Berlin (DE)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 15/926,482

(22) Filed: Mar. 20, 2018

(65) Prior Publication Data

US 2019/0294195 A1 Sep. 26, 2019

(51) Int. Cl.
*G05G 1/06* (2006.01)

(52) U.S. Cl.
CPC ..... *G05G 1/06* (2013.01)

(58) Field of Classification Search
CPC ..... G05G 1/06; G05G 1/04; G05G 1/082; G05G 1/085; G05G 1/08; G05G 1/10; G05G 1/58; G05G 1/62; G05G 1/54; G05G 5/005; G05G 5/28; G05G 5/065; G05G 9/047; G05G 2009/04703; F16D 1/112; F16D 1/108; E02F 9/2004; Y10T 74/20762; Y10T 74/20744; Y10T 74/20738; Y10T 74/20732
See application file for complete search history.

(56) References Cited

U.S. PATENT DOCUMENTS 2,062,108 A * 11/1936 Rickerson ..... F16D 1/108 403/348
4,535,647 A * 8/1985 Gault ..... G05G 5/18 74/473.33
4,943,182 A * 7/1990 Hoblingre ..... F16B 7/20 403/325
5,083,883 A * 1/1992 Ueda ..... B25G 3/26 403/316
5,995,034 A 11/1999 Liu
6,116,370 A * 9/2000 Puigbo ..... B60R 25/066 180/287

(Continued)

FOREIGN PATENT DOCUMENTS

DE 102014001747 A1 * 8/2015 ..... E02F 3/7604
FR 2733610 A1 * 10/1996 ..... E02F 9/2004
KR 20070005753 A 1/2007

OTHER PUBLICATIONS

UKIPO Search Report dated Jul. 16, 2019.

*Primary Examiner* — Daniel D Yabut
(74) *Attorney, Agent, or Firm* — Burns & Levinson, LLP; Joseph M. Maraia; Paul D. Sorkin

(57) ABSTRACT

A joystick includes a mechanism for facilitating the changing of a grip assembly. An actuation mechanism moves a ram into a position where the operator can press down on a locking pin to release the grip assembly. The ram will be in a default position that does not interfere with the operations of the joystick during normal operation. A relatively low amount of force is used to place the ram into position as the force needed to press down on the locking pin comes from the operator. A small electromagnetic that does not interfere with the joystick operations can be used in the actuation mechanism.

12 Claims, 12 Drawing Sheets

(56) References Cited

U.S. PATENT DOCUMENTS

| | | | | |
|---|---|---|---|---|
| 6,691,589 | B2 * | 2/2004 | Gillman | G05G 1/10 248/118.3 |
| 7,886,632 | B2 * | 2/2011 | Stoffers | E02F 9/2004 248/118.3 |
| 2002/0080114 | A1 * | 6/2002 | Numata | G05G 1/10 345/156 |
| 2006/0007144 | A1 * | 1/2006 | Mathiasen | G05G 9/047 345/161 |
| 2009/0007712 | A1 | 1/2009 | Laming et al. | |
| 2009/0168594 | A1 * | 7/2009 | Stephenson | A47J 43/0711 366/331 |
| 2013/0229272 | A1 * | 9/2013 | Elliott | G05G 9/047 340/407.2 |
| 2016/0085257 | A1 * | 3/2016 | Moehling | G05G 1/06 74/543 |

* cited by examiner

APPARATUS FOR REMOVING A JOYSTICK GRIP

BACKGROUND

A joystick is an input device having a grip, for a user to hold, connected to a column or "stick." In operation, the joystick pivots, per the actions of the operator, on a base and its angle, position and/or direction of movement are sent to the device being controlled. The joystick is the principal control device in the cockpit or cab of many machines and vehicles, including civilian and military aircraft, as well as land-based vehicles, such as tractors. The joystick will often include switches in the grip in order to control various other aspects of the vehicle's operation.

In, for example, a tractor where different tools can be attached, i.e., swapped out, the grip on the joystick also needs to be changed in order to provide the appropriate controls. In other words, the grip on a joystick will correspond to the current configuration or components of the vehicle, for example, a front end bucket loader or a jackhammer.

What is needed is a mechanism for changing out the grip on the joystick that is not susceptible to inadvertent removal or disconnection.

SUMMARY

According to one aspect of the disclosure, a joystick apparatus comprises a ram; and a positioning mechanism, coupled to the ram, configured to move the ram from a first predetermined position to a second predetermined position, wherein the second predetermined position is selected such that a locking pin on a grip assembly mounted on a receiving column can be depressed against a surface of the ram.

According to one aspect of the disclosure, a method of removing the grip assembly of a joystick use to operate a vehicle comprises energizing a positioning mechanism to move a ram from a first predetermined position to a second predetermined position; pressing a locking pin coupled to a locking pin opening of a receiving column of the grip assembly against a surface of the ram, after moving the ram to the second position, until the locking pin is decoupled from the receiving column; and removing the grip assembly after the locking pin has been decoupled from the receiving column.

According to one aspect of the disclosure, a joystick apparatus comprises a joystick base, comprising a receiving column having a groove and a locking pin opening defined therein and a grip assembly disposed in the receiving column. The grip assembly comprises a grip column; a guide post disposed on a surface of the grip column; and a locking pin disposed on the surface of the grip column, wherein the locking pin is coupled with the locking pin opening and the guide post is disposed in the groove of the receiving column. The joystick apparatus also comprises a ram; and a positioning mechanism, coupled to the ram, configured to move the ram from a first predetermined position to a second predetermined position, wherein the second predetermined position is selected such that the locking pin can be depressed against a surface of the ram and decoupled from the locking pin opening of the receiving column.

BRIEF DESCRIPTION OF THE DRAWINGS

Various aspects of the disclosure are discussed below with reference to the accompanying Figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, not every component may be labeled in every drawing. The Figures are provided for the purposes of illustration and explanation and are not intended as a definition of the limits of the disclosure. In the Figures.

DETAILED DESCRIPTION

Figure 1:
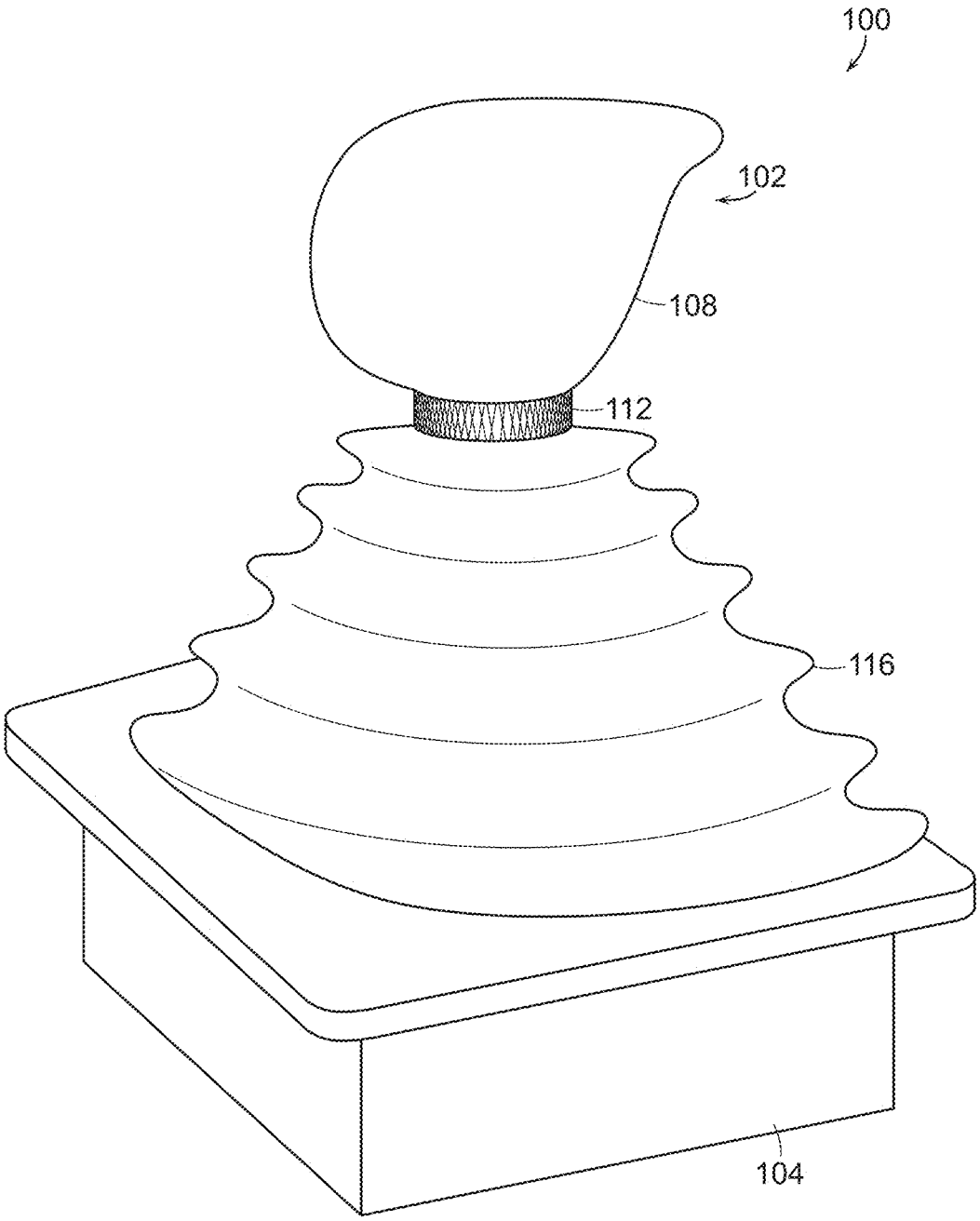
FIG. 1 is a perspective view of a joystick apparatus in accordance with an aspect of the present disclosure.

In the following description, details are set forth in order to provide a thorough understanding of the aspects of the disclosure. It will be understood by those of ordinary skill in the art that these may be practiced without some of these specific details. In other instances, well-known methods, procedures, components and structures may not have been described in detail so as not to obscure the aspects of the disclosure.

It is to be understood that the disclosure is not limited in its application to the details of construction and the arrangement of the components set forth in the following description or illustrated in the drawings as it is capable of implementations or of being practiced or carried out in other various ways. Also, it is to be understood that the phraseology and terminology employed herein are for the purpose of description only and should not be regarded as limiting.

Certain features, which are, for clarity, described in the context of separate implementations, may also be provided in combination in a single implementation. Conversely, various features, which are, for brevity, described in the context of a single implementation, may also be provided separately or in any suitable sub-combination.

It should be noted that, where used, "top," "bottom," "upper," "lower," etc., are merely for explaining the relative placement of components described herein. These relative placement descriptions are not meant to limit the claims with respect to a direction of gravity or a horizon.

Generally, and as will be described in more detail below, aspects of the present disclosure provide a joystick apparatus where the grip can be exchanged without the need for a tool. In addition, the grip can only be removed when the vehicle or machine is in a position or status where it is safe to do so. Thus, during normal operation, the grip is locked on the joystick.

Referring now to FIG. 1, a joystick apparatus 100, in accordance with an aspect of the present disclosure, includes a base 104 and a grip assembly 102. The grip assembly 102 includes a grip 108 mounted on a grip column 112 that is placed in a receiving column as described below. As is known, the receiving column is connected to numerous sensors, for example, Hall Effect sensors, to detect movement of the joystick apparatus 100 in order to control the vehicle. A flexible boot 116 surrounds the mechanism to prevent dirt and other items from interfering with proper operation.

Figure 2:
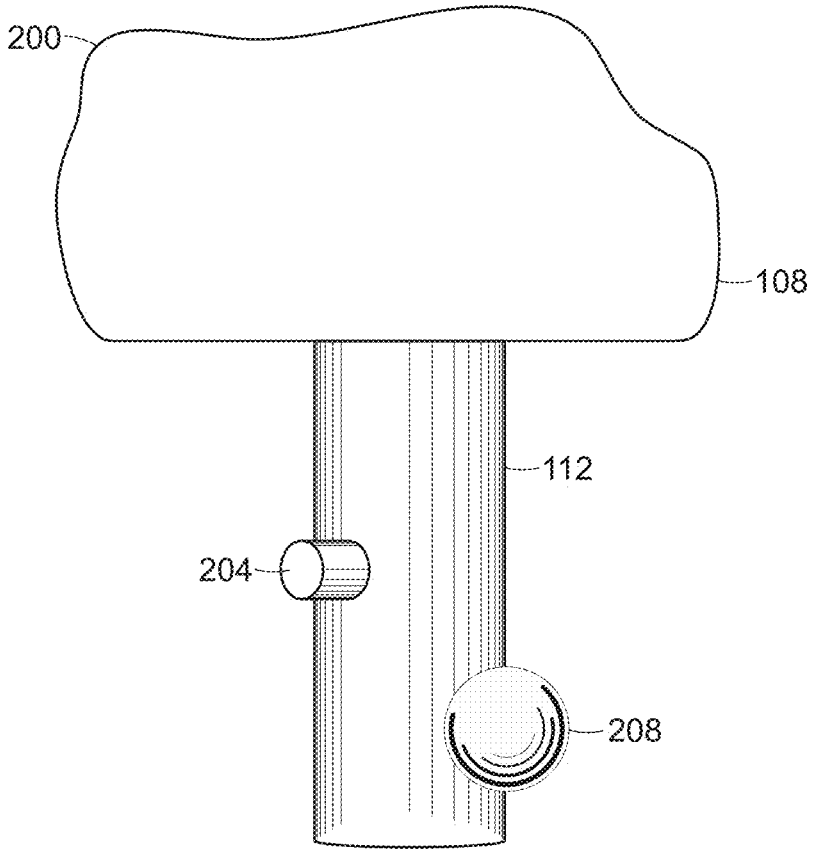
FIG. 2 is a grip assembly portion of the joystick apparatus shown in FIG. 1.

A fixed guide post 204 extends from the grip column 112, as shown in FIG. 2 (with the boot 116 removed). A spring-loaded locking pin 208 extends from within the grip column 112 and can be pushed back into the grip column 112. The column 112, guide post 204 and locking pin 208 may each be made of a metal, for example, aluminum, although any material, e.g., plastic, can be chosen as long as it can withstand the rigors of operation.

Figure 3:
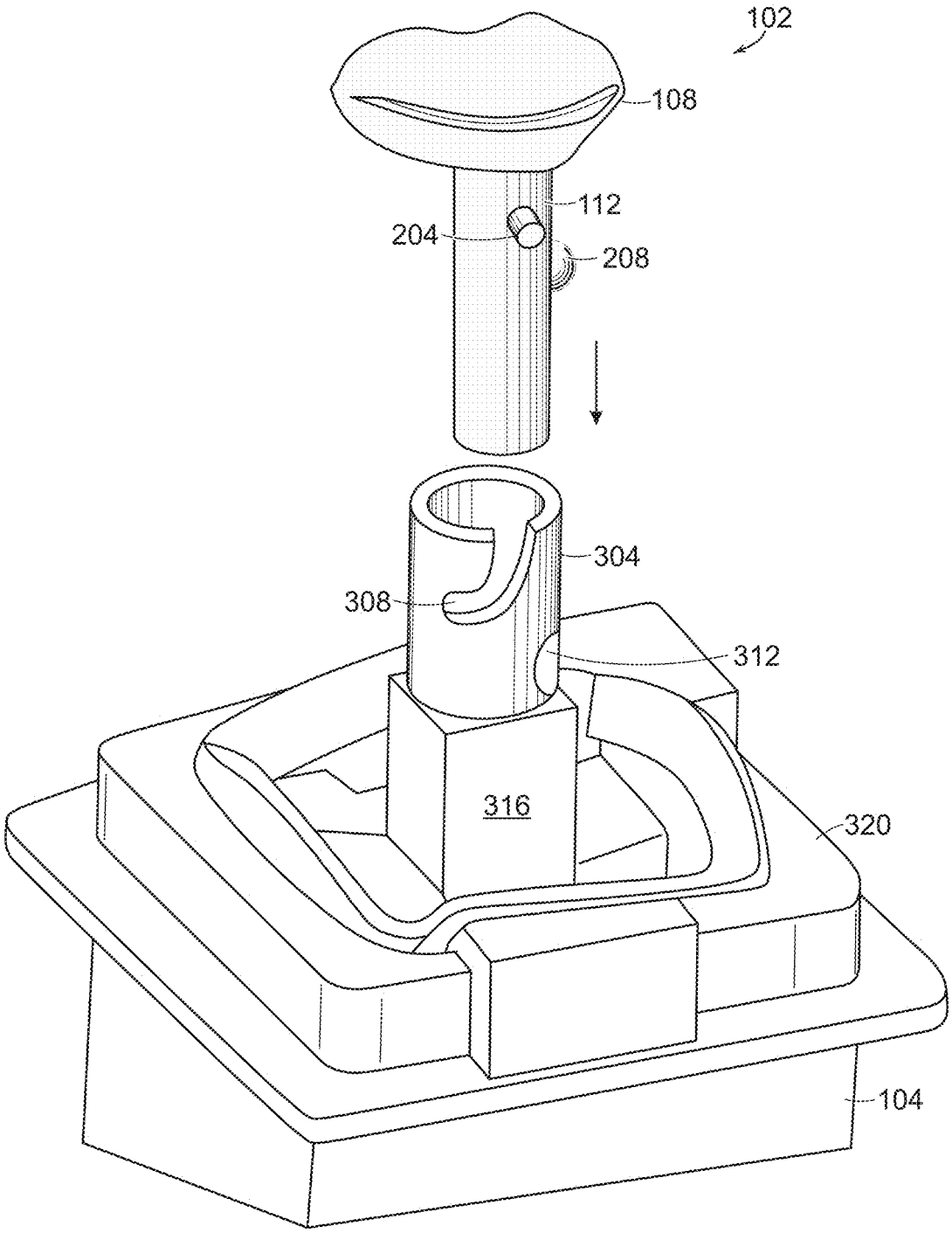
FIG. 3 is an exploded cutaway view of the joystick apparatus shown in FIG. 1.
Figure 4:
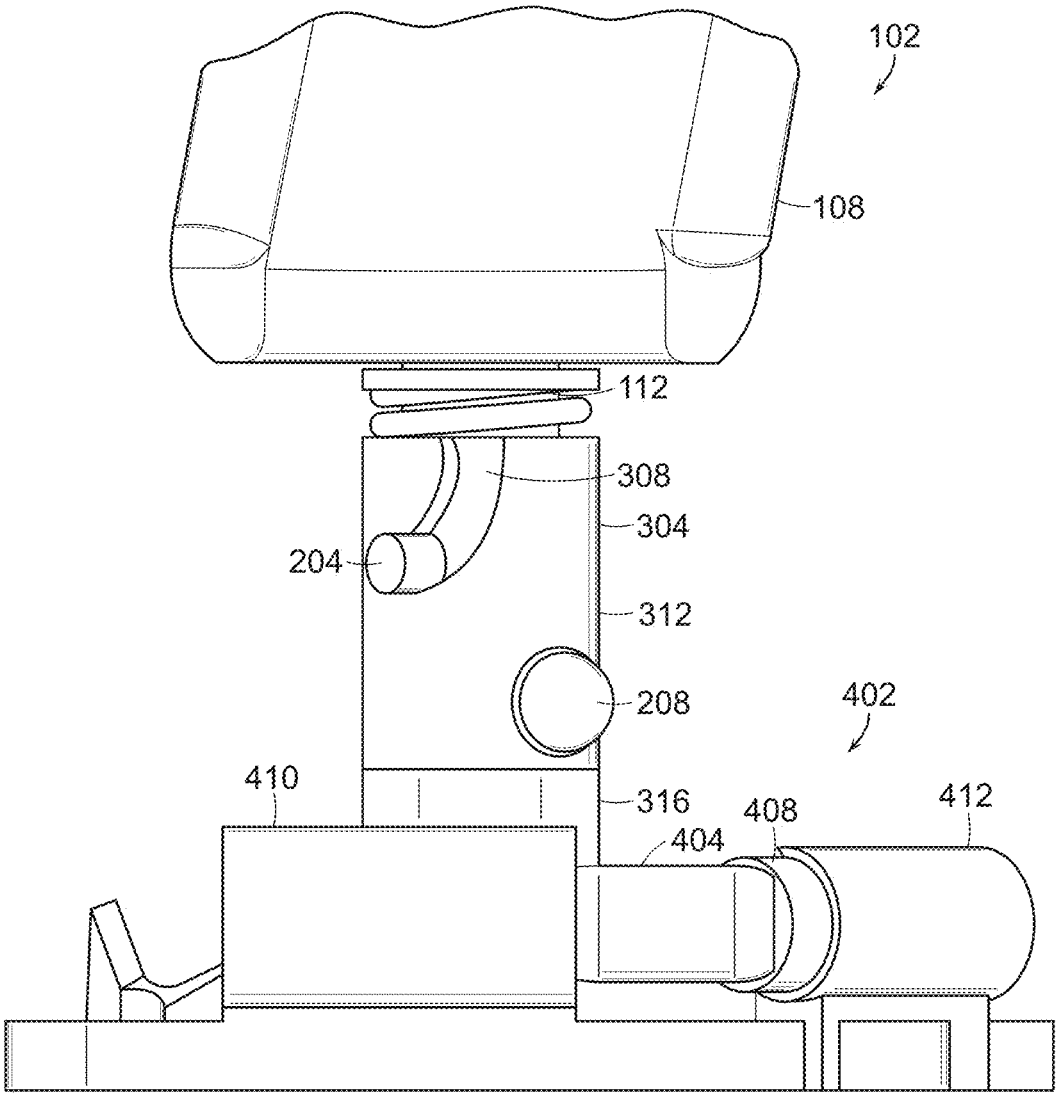
FIG. 4 is a close-up portion of the joystick apparatus shown in FIG. 1.

The grip assembly 102 is positioned in a receiving column 304 that is mounted on a joystick base 316, as shown in FIG. 3. A J-groove 308 is defined in the receiving column 304, as is a locking pin opening 312. The grip assembly 102 is guided into the receiving column 304 such that the guide post 204 follows along the J-groove 308 until the locking pin 208 extends from the opening 312. As the locking pin 208 is spring-loaded, it will be pushed into the grip column 112 until the guide post 204 has traveled the full length of the J-groove 308. When the locking pin 208 is fully extended from the opening 312, the grip assembly 102 is coupled to the receiving column 304, as shown in FIG. 4, within a joystick frame 320. Operation of the vehicle by the joystick is now enabled. Of course, one of ordinary skill in the art will understand that the arrangement of the guide post 204 and locking pin 208 in the column 112 corresponds with the arrangement of the groove 308 and opening 312 in the receiving column 304. In addition, the receiving column 304 and base 316 may each be made of a metal, for example, aluminum, although any material can be chosen as long as it can withstand the rigors of operation. While a J-groove is described, one of ordinary skill in the art will understand that a groove of a different shape could also be implemented and that another approach would have no groove or guide post 204 and just use the locking pin 208.

One of ordinary skill in the art will understand that the grip assembly 102 can be removed by depressing the locking pin 208 and moving the guide post 204 up and along the J-groove 308. It is important, however, that the grip assembly 102 not be easily, i.e., inadvertently, released or loosened from the receiving column 304 during normal operation of the joystick, i.e., while the vehicle is being controlled or in motion. Thus, the locking pin 208 should not be depressed or pushed unless the intention is to swap out the grip assembly 102.

Advantageously, as will be described below, a grip remover mechanism 402 is provided to aid the operator in removing the grip assembly 102 when the operator indicates the intention to do so. The grip remover mechanism 402 includes a positioning mechanism 410 coupled to an actuator 404 coupled that is coupled to a ram 408 disposed within a ram guide 412, as shown in FIG. 4.

Figure 5A:
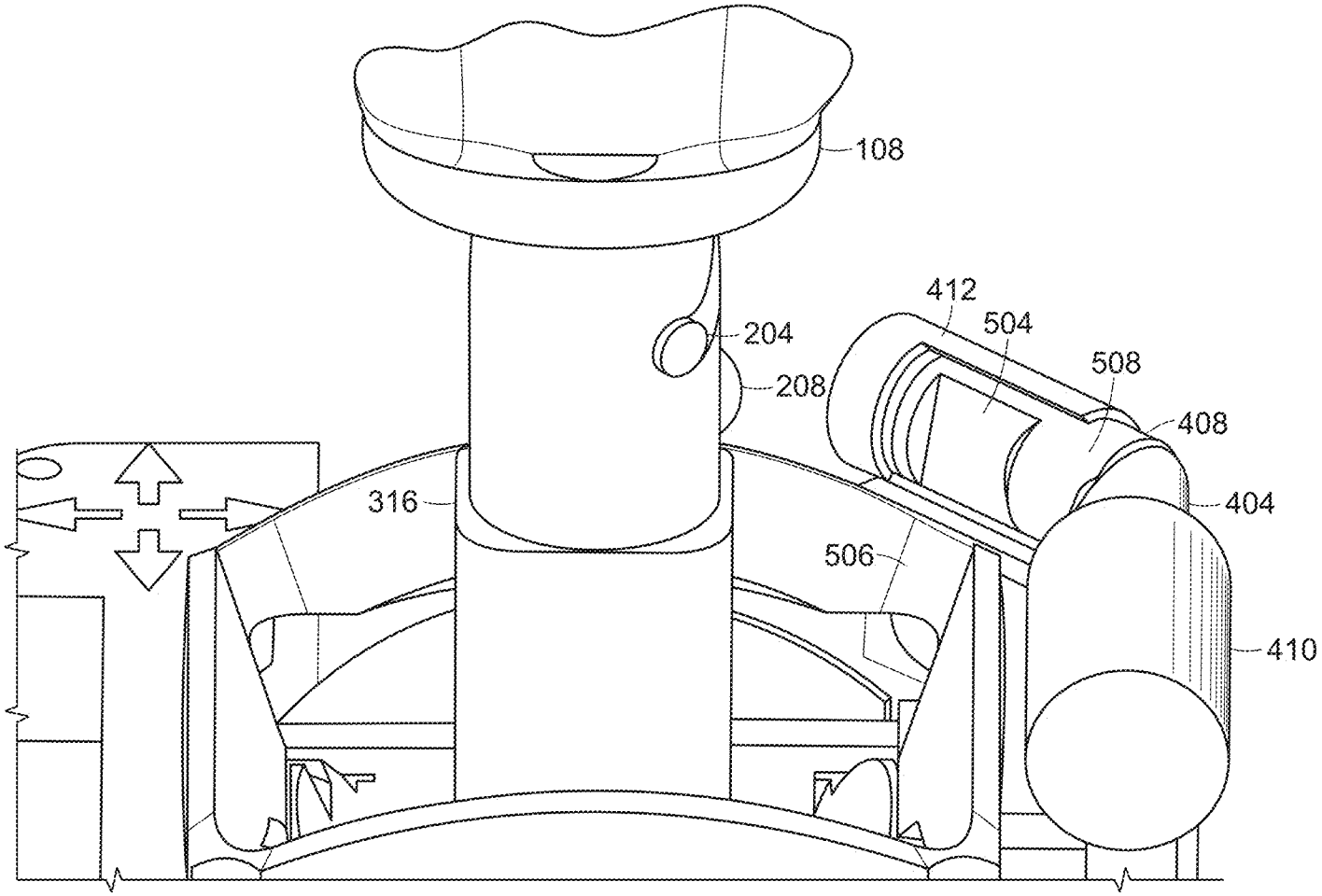
FIG. 5A is a close-up view of a grip remover mechanism in accordance with an aspect of the present disclosure.

The positioning mechanism 410 is energized when the grip assembly 102 is to be changed. The positioning mechanism 410 may comprise an electromagnet coupled to the actuator 404. When the mechanism 410 is not energized, the actuator 404 and, therefore, the ram 408, are in a default position when the vehicle is being normally operated, as shown in FIG. 5A. The mechanism 410 may comprise a spring or other device to urge the actuator 404 to the first default position where the force of the spring or other device is overcome when the mechanism 410 is energized.

In the default position, referring to FIG. 5A, an indent 504 that is provided in the ram 408 is aligned with a positioning groove 506 in the frame 320. When the joystick base 316 is moved toward the indent 504, for example, during normal operation, the locking pin 208 will not make contact, or will not make sufficient contact, with any portion of the ram 408 that would cause the pin 208 to recede into the receiving column 304 and inadvertently allow for the release of the grip assembly 102.

Figure 5B:
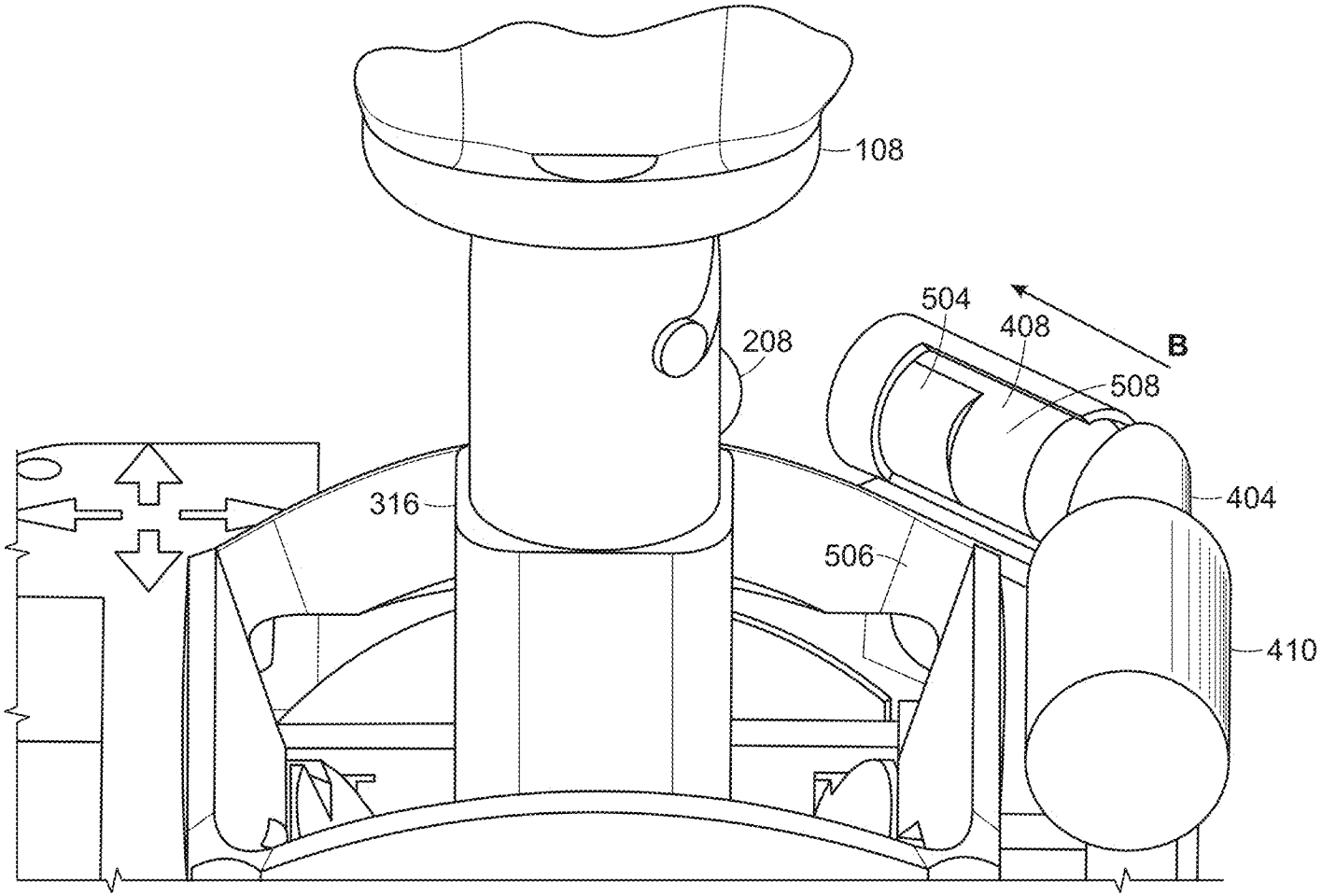
FIG. 5B is a close-up view of the grip remover mechanism in accordance with an aspect of the present disclosure.
Figure 6:
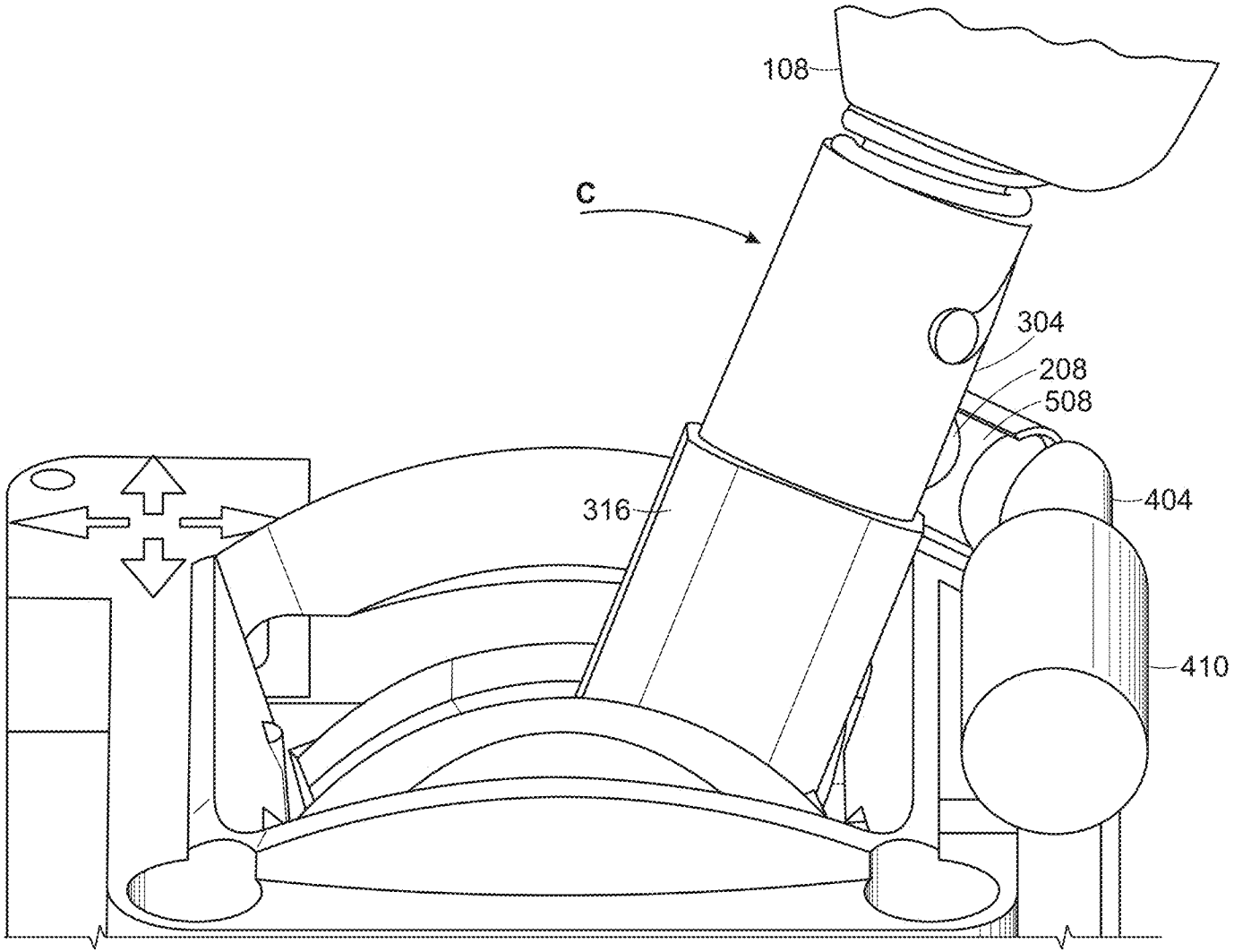
FIG. 6 shows the grip remover mechanism in operation in accordance with an aspect of the present disclosure.
Figure 7A:
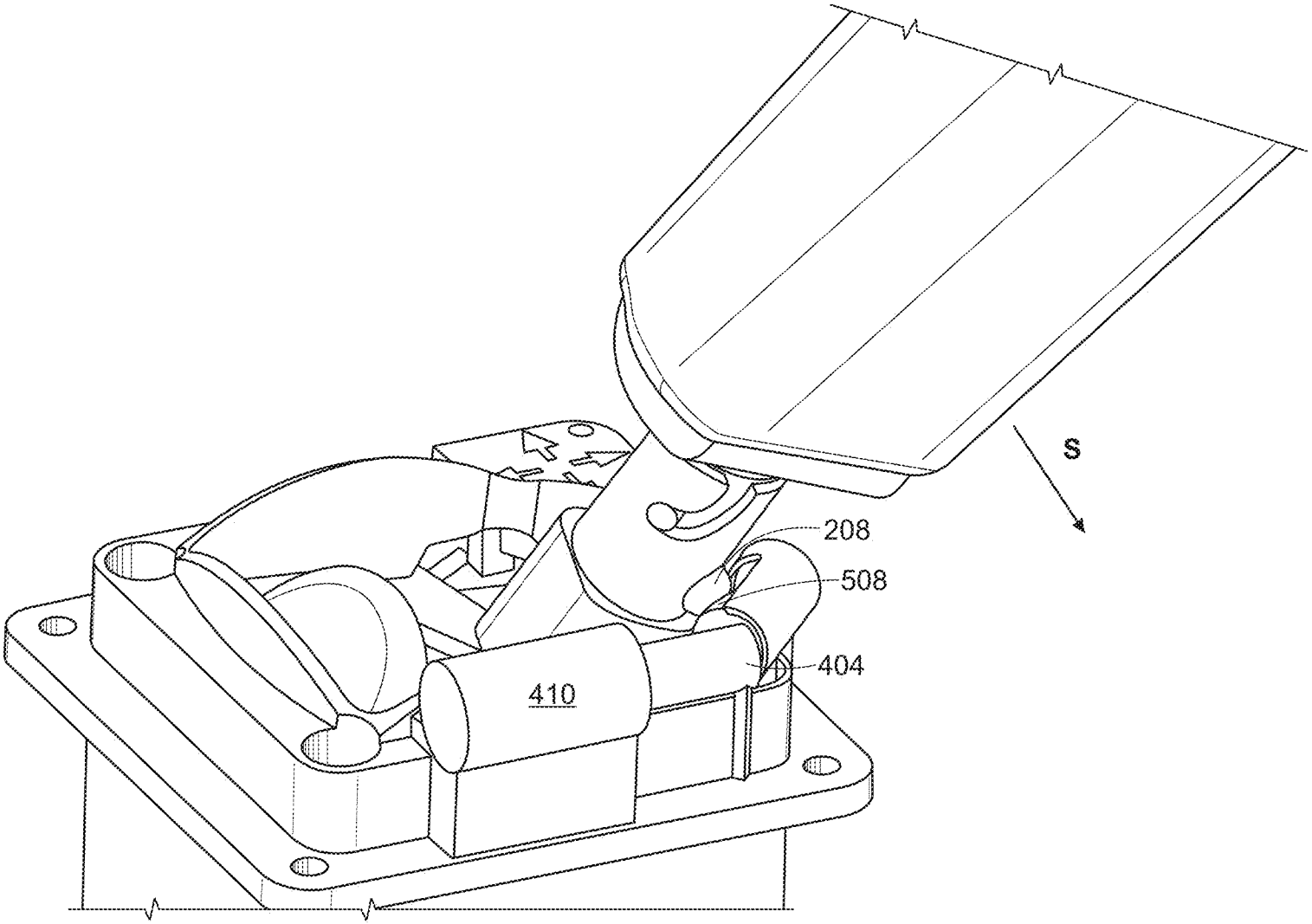
FIG. 7A shows the grip remover mechanism in operation in accordance with an aspect of the present disclosure.
Figure 7B:
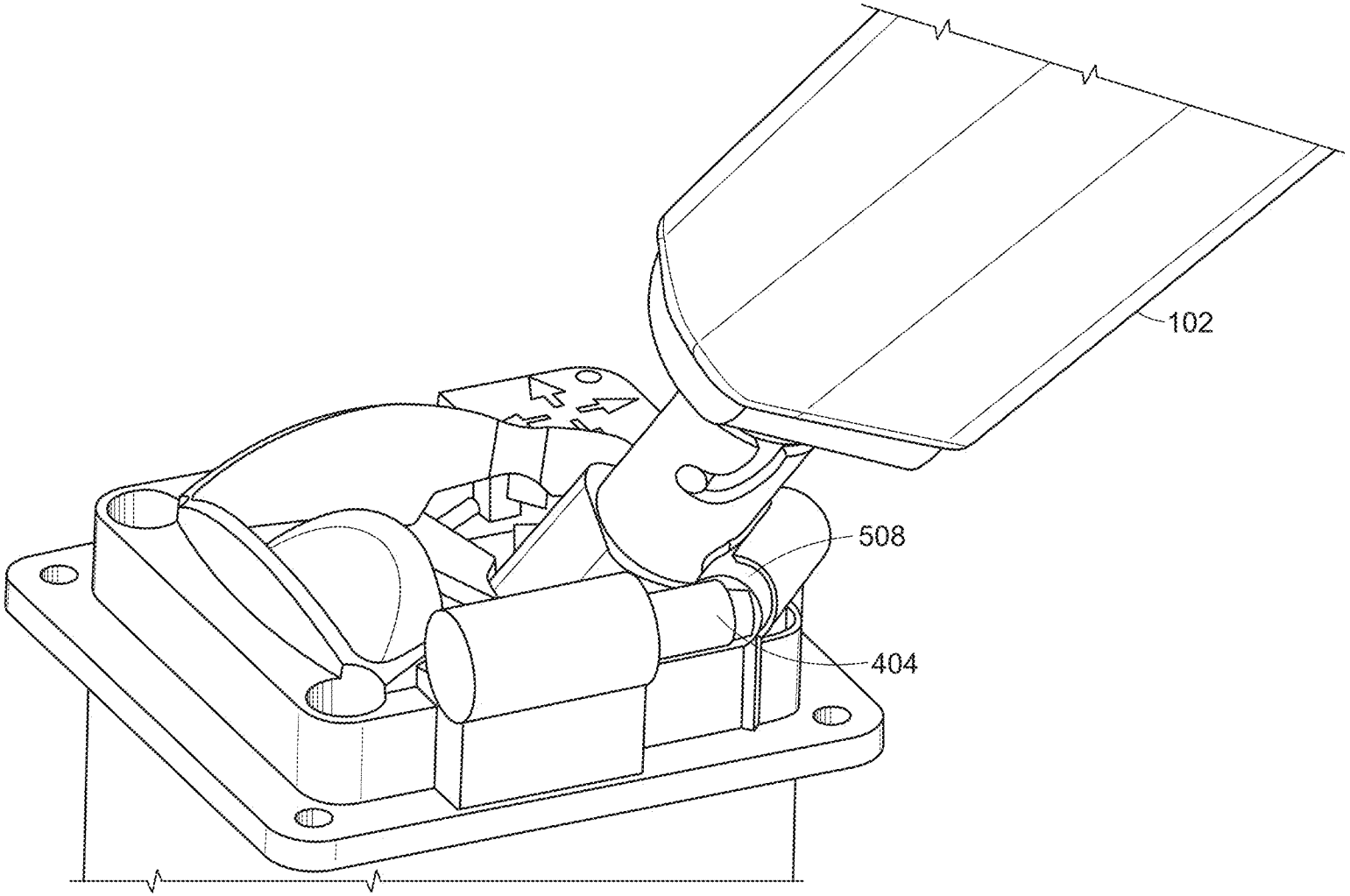
FIG. 7B shows the grip remover mechanism in operation in accordance with an aspect of the present disclosure.
Figure 8A:
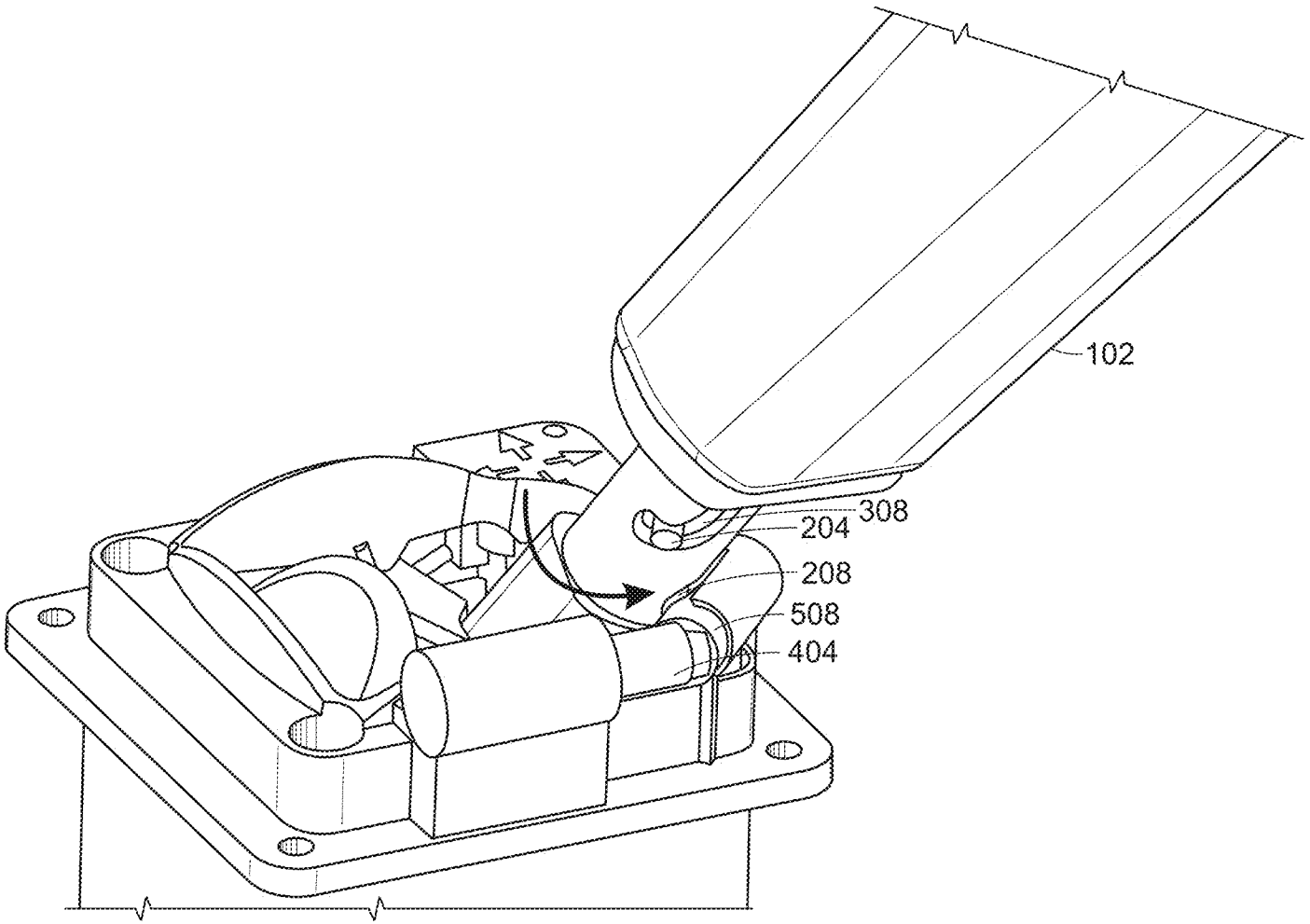
FIG. 8A shows the grip remover mechanism in operation in accordance with an aspect of the present disclosure.
Figure 8B:
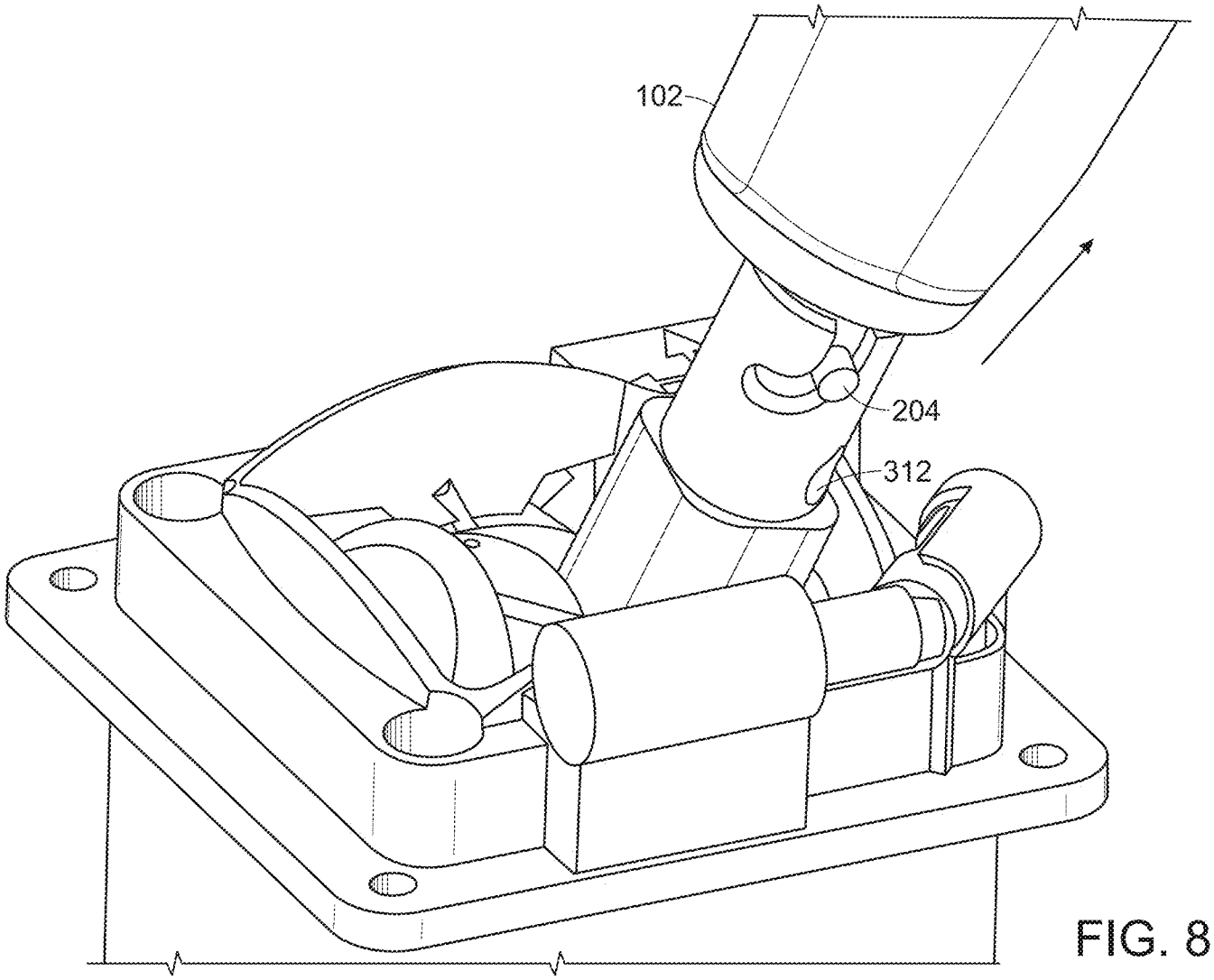
FIG. 8B shows the grip remover mechanism in operation in accordance with an aspect of the present disclosure.

When the grip assembly 102 is to be changed, the mechanism 410 is energized and the actuator 404 moves the ram 408, per arrow B in FIG. 5B, such that a pin release surface 508 of the ram 408 is aligned with the positioning groove 506. Accordingly, when the joystick base 316 is moved into position against the positioning groove 506, see arrow C in FIG. 6, the locking pin 208 contacts the pin release surface 508 and the locking pin 208 is depressed. Continuing to force the locking pin 208 against the pin release surface 508 in a direction shown by arrow S in FIG. 7A will allow the locking pin 208 to clear the opening 312 as shown in FIG. 7B. The grip assembly 102 can be turned by the operator, see FIG. 8A, to move the guide post 204 within the J-groove 308 and then the grip assembly 102 is removed, as shown in FIG. 8B. Once the grip assembly 102 has been removed, the joystick base 316 reverts to a neutral position as shown in FIG. 3.

The pin release surface 508 may include a structure or structures to facilitate moving the locking pin 208 sufficiently far enough to clear the opening 312. These structures may include, but are not limited to, a bump, knob or a post.

Advantageously, a relatively small electromagnet controlled ram 408 in one defined corner of the joystick base 320 can be used because the force for unlocking the grip is generated by the user when pushing against the pin release surface 508. An electromagnet with a strength that does not interfere with any Hall Effect sensors that may be used for detecting the movement of the joystick can be chosen as would be understood by one of ordinary skill in the art.

The ram 408 may be made from any material sufficiently strong to press against the locking pin 208, for example, aluminum or a hard plastic, and could be a hollow or solid piece. Generally, any material harder than the material used for the locking pin 208 will suffice. The ram 408 may be cylindrical, as shown, but need not be limited to that geometry and could be square, rectangular or triangular. The guide 412 would be of a corresponding shape but is not a requirement of any aspect of the present disclosure.

The ram 408 is shown as including an indent 504 in order for the ram 408 to not interfere with the locking pin 208 during normal operation. An alternate aspect of the present disclosure includes a shorter ram 408 that is moved into position when the grip assembly 102 is to be changed, otherwise, there remains an opening in the ram guide 412.

Figure 9:
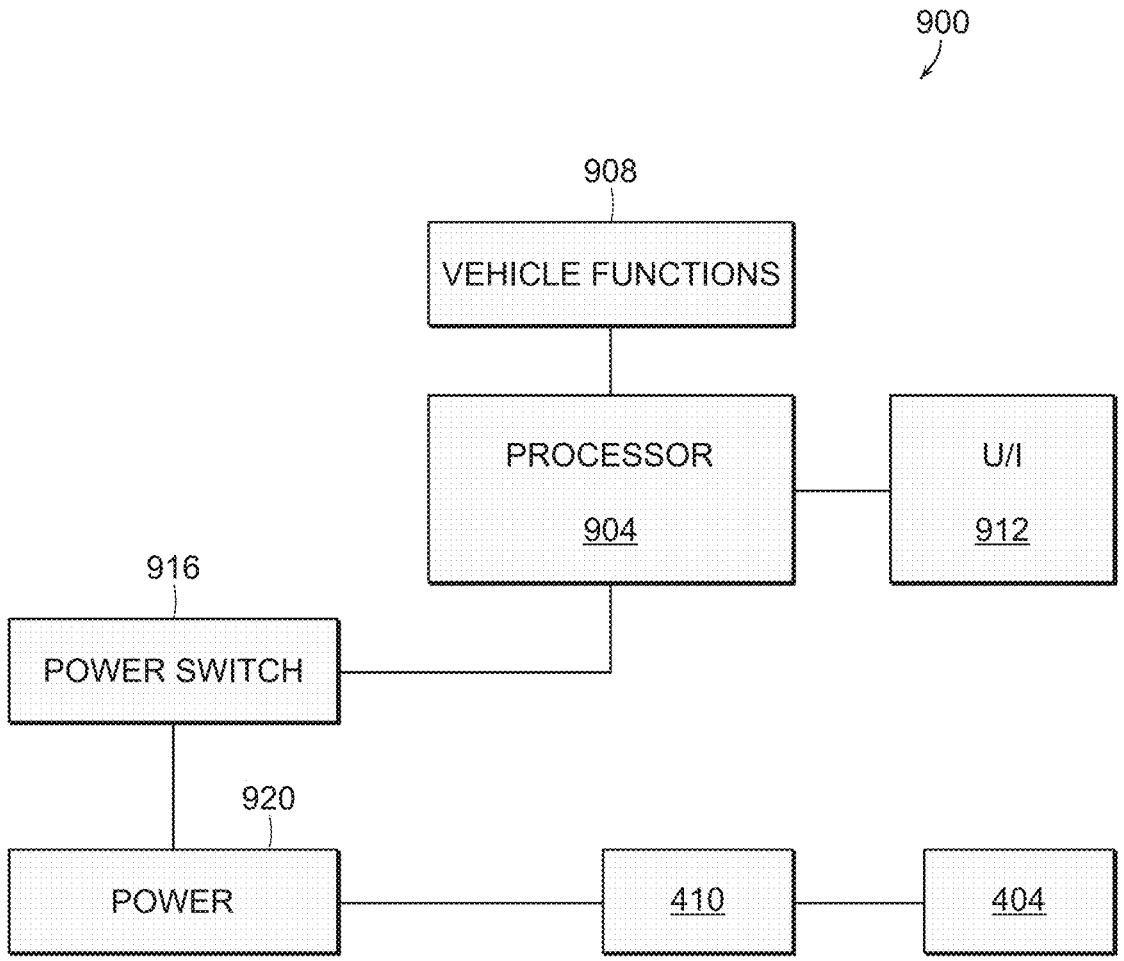
FIG. 9 is a functional block diagram of a system in accordance with an aspect of the present disclosure.

Referring now to FIG. 9, a system 900 for operating the positioning mechanism 410 includes a processor 904, for example, a general purpose computer appropriately programmed, as known to one of ordinary skill in the art. The system 900 is coupled to, and controls, the vehicle functions 908. A user interface 912, for example, a touchscreen, mouse, keyboard, etc., is provided to communicate with, and receive input from, the operator. The processor 904 is coupled to a power switch 916 that controls a power source 920 coupled to the positioning mechanism 410.

The operator, when desiring to change the grip, can access the feature through the user interface 912. The processor 904 will confirm that the vehicle is in a condition or state where the grip can be removed and will place the vehicle in a safe state, i.e., where the operation of the joystick is disabled. The processor 904 will control the switch 916 to turn on the power 920 and cause the actuator 404 to move into place to allow the operator to remove and replace the grip per the description above. In one aspect, the processor 904 may only turn on the switch 916 for a predetermined time after which the actuator 404 is withdrawn.

The present disclosure is illustratively described above in reference to the disclosed implementations. Various modifications and changes may be made to the disclosed implementations by persons skilled in the art without departing from the scope of the present disclosure as defined in the appended claims.

What is claimed is:

1. A joystick, comprising:

a base;

a ram guide stationarily fixed to the base;

a ram positioned within the ram guide; and a positioning mechanism, coupled to the ram, configured to linearly move the ram along, and within, the ram guide from a first predetermined ram position to a second predetermined ram position, wherein the second predetermined ram position is located such that a spring-loaded locking pin extending from within a grip column of a grip assembly mounted on a receiving column, the receiving column supported by the base, can be depressed against a surface of the ram and decoupled from a locking pin opening of the receiving column, and wherein the first predetermined ram position is located such that the spring-loaded locking pin cannot be depressed against the surface of the ram and decoupled from the locking pin opening.

2. The joystick apparatus of claim 1, wherein the positioning mechanism comprises an electromagnet.

3. The joystick apparatus of claim 1, further comprising an actuator coupling the positioning mechanism to the ram.

4. The joystick apparatus of claim 1, wherein the ram comprises a cylinder.

5. The joystick apparatus of claim 1, wherein the first predetermined ram position is a default position when no power is applied to the positioning mechanism.

6. The joystick apparatus of claim 1, wherein a first portion of the ram is located adjacent a preset location on a joystick frame when the ram is at the first predetermined ram position and a second portion of the ram is located at the preset frame location when the ram is at the second predetermined ram position.

7. A joystick apparatus, comprising:

an apparatus base;

a joystick base, supported by the apparatus base, comprising:

a receiving column having a groove and a locking pin opening defined therein;

a grip assembly, disposed in the receiving column, comprising:

a grip column;

a guide post disposed on, and extending from, a surface of the grip column; and a spring-loaded locking pin extending from within the grip column, wherein the spring-loaded locking pin is releasably coupled with the locking pin opening and the guide post is disposed in the groove of the receiving column;

a ram guide stationarily fixed to the apparatus base;

a ram positioned within the ram guide; and a positioning mechanism, coupled to the ram, configured to linearly move the ram along, and within, the ram guide from a first predetermined ram position to a second predetermined ram position, wherein the second predetermined ram position is located such that the spring-loaded locking pin can be depressed against a surface of the ram and decoupled from the locking pin opening of the receiving column, and wherein the first predetermined ram position is located such that the spring-loaded locking pin cannot be depressed against the surface of the ram and decoupled from the locking pin opening.

8. The joystick apparatus of claim 7, wherein the positioning mechanism comprises an electromagnet.

9. The joystick apparatus of claim 7, further comprising an actuator coupling the positioning mechanism to the ram.

10. The joystick apparatus of claim 7, wherein the ram comprises a cylinder.

11. The joystick apparatus of claim 7, wherein the first predetermined ram position is a default position when no power is applied to the positioning mechanism.

12. The joystick apparatus of claim 7, wherein a first portion of the ram is located adjacent a preset location on a joystick frame when the ram is at the first predetermined ram position and a second portion of the ram is located at the preset frame location when the ram is at the second predetermined ram position.

* * * * *